US006032811A

United States Patent [19]

Marconi

[11] Patent Number: 6,032,811

[45] Date of Patent: Mar. 7, 2000

[54] CHILD RESISTANT CAP ASSEMBLY

[76] Inventor: Anthony Marconi, 385 W. 15th St., Chicago Heights, Ill. 60411

[21] Appl. No.: 09/148,059

[22] Filed: Sep. 4, 1998

[51] Int. Cl.[7] ..... B65D 41/00

[52] U.S. Cl. ..... 215/228; 215/206; 215/207; 215/215; 215/230; 220/212; 220/284

[58] Field of Search ..... 220/210, 212, 220/284; 215/206, 207, 215, 228, 230, 334

[56] References Cited

U.S. PATENT DOCUMENTS

| | | | |
|---|---|---|---|
| 2,381,207 | 8/1945 | Coleman | 215/206 |
| 3,073,468 | 1/1963 | Arneson | 215/334 X |
| 3,164,277 | 1/1965 | Reading . | |
| 3,710,970 | 1/1973 | Elfline . | |
| 4,991,730 | 2/1991 | Pehr . | |
| 5,147,052 | 9/1992 | Minette . | |
| 5,437,382 | 8/1995 | Gluckman . | |
| 5,509,550 | 4/1996 | DeJonge . | |

*Primary Examiner*—Stephen P. Garbe
*Assistant Examiner*—Robin A. Hylton
*Attorney, Agent, or Firm*—Kenneth L Tolar

[57] ABSTRACT

A child resistant cap assembly includes an outer cap member having a top wall and a substantially cylindrical side wall depending therefrom. On the exterior surface of the top wall is a key slot and an alignment aperture. An inner cap member for threadedly engaging a container neck is concentrically received within said outer cap member has a mark and key slot on its top wall. The outer cap member normally rotates independently of the inner cap member. When the outer cap member's alignment aperture registers with the mark on the inner cap member, the key slots are aligned allowing a key member to be inserted therethrough. Accordingly, the inserted key member is then rotated to simultaneously rotate the inner and outer cap. The top wall of the outer cap member also includes means for removably retaining the key thereon.

5 Claims, 1 Drawing Sheet

CHILD RESISTANT CAP ASSEMBLY

BACKGROUND OF THE INVENTION

The present invention relates to a child resistant cap assembly for household containers.

DESCRIPTION OF THE PRIOR ART

Medications, cleaners and similar potentially toxic materials are typically stored within small containers which are enclosed with a threaded cap making them easily accessible by a child or infant. Although many caps feature a child resistant means, most only require the cap to be depressed slightly while rotating the cap.

The present invention provides a dual cap assembly which may only be removed with an attachable key whenever slots on the two caps are aligned. When the cap is secured to a container, the key may be removed and stored in a location that is inaccessible by a child or infant.

Various child proof caps exist in the prior art. For example, U.S. Pat. No. 5,509,550issued to DeJonge relates to a child resistant cap with an automatic release key. The device includes an inner cap and an outer cap with a key secured thereto. The key is pivotable one hundred eighty degrees to engage a release key engagement on the inner cap.

U.S. Pat. No. 5,437,382issued to Gluckman relates to a safety lock pill container having a removable stopper located within the neck of the container and a cap disposed over the neck. The cap may be removed and inverted to function as a tool or driver for removing the stopper.

U.S. Pat. No. 5,147,052issued to Minette relates to a child resistant closure including an inner cap having projections on its top surface that protrude through the top of an outer cap.

U.S. Pat. No. 4,991,730issued to Pehr relates to a captive key release closure structure including a base ring for connection to a rim of a container and a cap integrally hinged to the base ring. The cap has protrusions which mate with indentions on the base ring. The cap may be separated from the base ring by inserting a coin or similar item into a slot and twisting the coin.

U.S. Pat. No. 3,710,970issued to Elfline relates to a safety closure including an inner and an outer cap which are interlocked with shoulders on the caps' respective side walls. A clover shaped key is received within an opening on the top cap and is integrally attached thereto. The key is pried from the openings to allow the outer cap to freely rotate relative to the inner cap. To remove the device, the recess is aligned with a recess on the inner cap and the key is inserted therethrough. The device is designed to be interchangeably used as a safety cap or as an ordinary closure.

U.S. Pat. No. 3,164,277issued to Reading relates to a safety bottle cap including an inner cap and an outer cap. The inner cap includes a coin slot for receiving a coin or similar tool when removing the inner cap.

The above described devices have several disadvantages. With the device disclosed in DeJonge, the key is not removable allowing older children and other sophisticated persons to open the cap. The device disclosed in Reading includes an integrally attached key that must be physically detached from the cap which is burdensome and inconvenient. Furthermore, the device includes numerous interrelated parts and is therefore difficult and expensive to manufacture. Also, when rotating the outer cap member, it is necessary to maintain axial pressure thereon to prevent the key from rotating out of the recess. The present invention provides a simple, easy to use cap assembly in which an elongated key is conveniently stored on the top of an outer cap. The key is inserted into aligned slots the outer cap and an inner cap allowing the assembly to be easily removed.

SUMMARY OF THE INVENTION

The present invention relates to a child proof cap assembly for use with conventional household containers that have an externally threaded neck portion. The device includes an outer cap member having a circular top wall and a cylindrical side wall depending therefrom. On the top wall is a key slot and an alignment aperture. Concentrically received within the outer cap member is an inner cap member having a similar key slot and indicia thereon. The key slot and indicia on the inner cap member are oriented such that, when the indicia is aligned with the aperture on the outer cap, the respective key slots are aligned. The outer cap member normally rotates independently of the inner cap member preventing the inner cap member from being unthreaded from the container neck. However, when the slots are aligned, a key may be inserted therethrough allowing both the inner and outer cap member to be simultaneously rotated to remove the assembly. The key may either be stored on the top wall of the outer cap member or in a remote location. It is therefore an object of the present invention to provide a child resistant cap for a container that prevents unauthorized users from removing the cap.

It is yet another object of the present invention to provide a child resistant cap assembly that is inexpensive to manufacture and easy to use.

It is yet another object of the present invention to provide a child resistant cap assembly operable with a key that can be removed from the cap assembly and stored in a remote location.

Other objects, features and advantages of the present invention will become readily apparent from the following detailed description of the preferred embodiment when considered with the attached drawings and the appended claims.

DESCRIPTION OF THE PREFERRED EMBODIMENT

Figure 3:
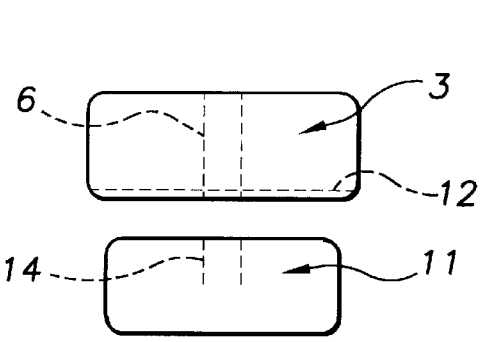
FIG. 3 is an exploded side view of the inventive device.
Figure 2:
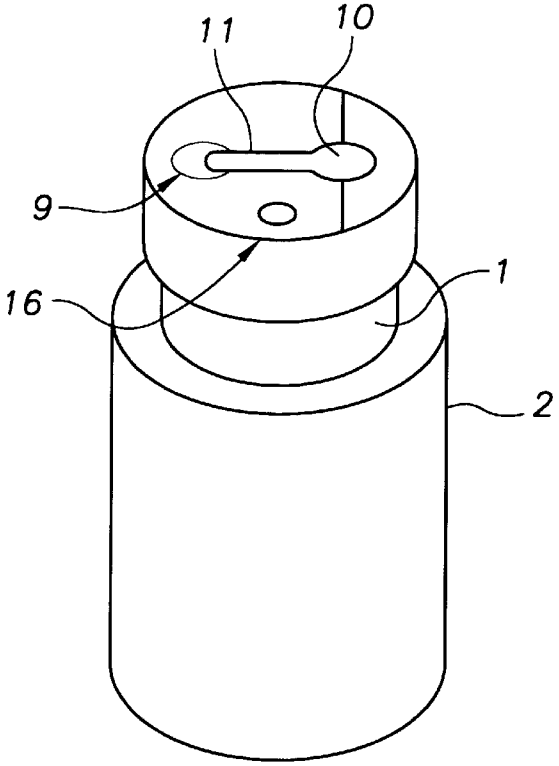
FIG. 2 depicts the inventive device installed on a household container.
Figure 1:
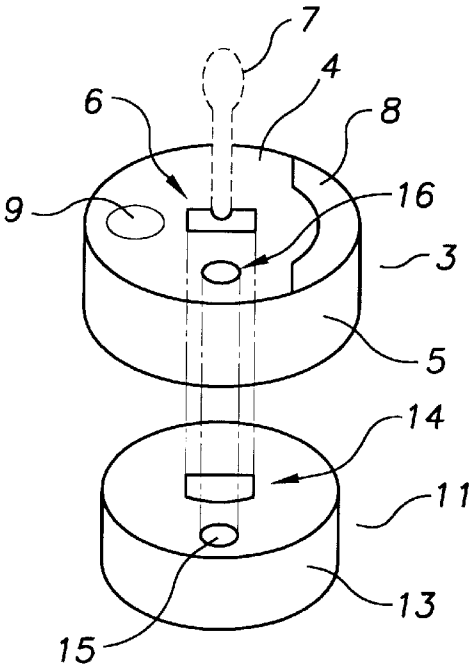
FIG. 1 is an exploded, perspective view of the inventive device.

Referring now to FIGS. 1 through 3, the present invention relates to a child resistant cap assembly for various household containers. Conventional household containers 2 typically include a neck 1 having an externally threaded portion with a threaded, removable cap secured thereto. The present invention relates to a child resistant cap assembly for coupling with the threaded neck of a conventional container of the type described above.

The device comprises an outer cap member 3 having a planar, substantially circular top wall 4 with a cylindrical side wall 5 depending from its peripheral edge. On the top wall is a key slot 6 for receiving a key 7. The top wall also includes an arcuate retaining wall 8 that retains the key on the top wall when not in use. An indention 9 is disposed on the upper surface of the top wall to assist a user in separating the key therefrom. The top wall also includes an alignment aperture 16 for assisting a user in aligning the key slot with a similar slot on an inner cap member as will be described below.

An inner cap member 11 is concentrically received within the outer cap member. The inner cap member is retained within the outer cap member by a tapered lip 12 extending inwardly from the bottom edge of the outer cap member side wall. The inner cap member has a substantially identical configuration as that of the outer cap member and includes an internally threaded cylindrical side wall 13 that is threadedly coupled with the externally threaded neck portion of the container. On the top wall of the inner cap member is a key slot 14 substantially similar to that of the outer cap member. Adjacent the peripheral edge of the top wall is a mark 15 or similar indicia. The mark and key slot are relatively oriented such that when the mark is aligned with the aperture on the upper cap member, the respective key slots will be aligned.

The key includes an elliptical gripping portion 10 with an elongated slot engaging portion 11 integrally extending therefrom. The key may be conveniently stored on the top wall of the outer cap member by placing the elliptical gripping portion against the retaining wall with the distal end of the elongated portion resting above the recess.

Accordingly, if an unauthorized user attempts to remove the cap assembly by grasping and rotating the outer cap, the outer cap member will freely rotate relative to the inner cap preventing the inner cap member from being unthreaded. To remove the device, a user rotates the outer cap member until the mark on the inner cap member is visible within the alignment aperture on the outer cap member. The elongated portion of the key is then inserted into the aligned key slots and the gripping portion of the key member is grasped and rotated in a predetermined direction to unthread the inner cap member from the container.

The various components of the above described device are preferably manufactured with plastic. However, as will be readily apparent to those skilled in the art, the size, shape and materials of construction of the various components may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a container having an externally threaded neck, a child resistant cap assembly comprising:

an outer cap member having a top wall with a circular peripheral edge and a cylindrical side wall depending therefrom, said top wall having a first key slot and an alignment aperture thereon;

an inner cap member concentrically received within said outer cap member, said inner cap member having a top wall and a cylindrical side wall depending therefrom, said side wall being internally threaded for threadedly coupling said inner cap to the threaded neck of said container, said top wall of said inner cap member having indicia and a second key slot thereon, said indicia and said second slots relatively disposed such that said first and second slots are aligned whenever said indicia aligns with said alignment aperture;

a key removably secured to the top wall of said outer cap member, said key including an elongated portion for inserting into said aligned key slots to simultaneously rotate said inner and outer cap members.

2. A device according to claim 1 wherein said key further includes an elliptical gripping portion integrally extending from the elongated portion which may be grasped by a user when said elongated portion is inserted into said slots.

3. A device according to claim 2 further comprising an arcuate retaining wall extending from the top wall of said outer cap member and adjacent the peripheral edge thereof dimensioned to receive and retain the gripping portion of said key.

4. A device according to claim 3 wherein the top wall of said outer cap member further includes an indention thereon over which a portion of said key is disposed when said gripping portion is adjacent said retaining wall to assist a user in removing said key from said top wall.

5. A device according to claim 1 wherein the cylindrical side wall of said outer cap member includes a lower edge having a lip depending inwardly therefrom for retaining said inner cap member within said outer cap member.

* * * * *